United States Patent [19]

Groeschel

[11] 4,080,863

[45] Mar. 28, 1978

[54] ELECTROSTATIC EXPRESSION ENCODING APPARATUS FOR PERCUSSIVE KEYBOARD INSTRUMENTS

[76] Inventor: Charles R. Groeschel, 2402 Ansbury, Houston, Tex. 77018

[21] Appl. No.: 736,254

[22] Filed: Oct. 27, 1976

[51] Int. Cl.[2] ..... G10H 1/02

[52] U.S. Cl. ..... 84/1.27; 84/1.1

[58] Field of Search ..... 84/1.01, 1.09, 1.1, 84/1.18, 1.27, DIG. 7, 21-23, 246

[56] References Cited

U.S. PATENT DOCUMENTS

| | | | |
|---|---|---|---|
| 1,318,977 | 10/1919 | Darley, Jr. | 84/1.1 |
| 3,328,507 | 6/1967 | Peterson | 84/1.1 |
| 3,375,320 | 3/1968 | Carras | 84/1.09 |
| 3,514,522 | 5/1970 | Mussulman | 84/1.18 |
| 3,657,459 | 4/1972 | Peterson et al. | 84/1.01 |
| 3,965,789 | 6/1976 | Pearlman | 84/1.24 |

*Primary Examiner*—Robert K. Schaefer

*Assistant Examiner*—Vit W. Miska

*Attorney, Agent, or Firm*—Donald Gunn

[57] ABSTRACT

A device for encoding the expression of a keyboard percussive instrument is disclosed. The apparatus places a suitable AC voltage on a coating applied to a hammer and positions a pair of capacitive coupled pads near the string to be struck by the hammer. As the hammer sweeps past the pads, signals are capacitively coupled from the hammer motion to the pads. Suitable latches are set and unset to form a signal which is coupled through a switch, a sample and hold amplifier, then to an analog to digital convertor which forms an expressive signal of N bits length. The signal is begun by depression of the key and is terminated by closure of the key upon release by the musician, the key of the instrument being provided with capacitive pickup pads coupled to the key and through a reset gate to the latches. Alternate embodiments are additionally disclosed.

10 Claims, 3 Drawing Figures

ELECTROSTATIC EXPRESSION ENCODING APPARATUS FOR PERCUSSIVE KEYBOARD INSTRUMENTS

BACKGROUND OF THE INVENTION

About fifty years ago, the American Piano Company attempted to encode expression of a keyboard instrument, typically a piano but also including a harpsicord, using a set of contacts spaced from one another in near proximity to the path of the piano hammer. Innumerable problems were encountered with this equipment, and they centered mostly around the adjustment of the contacts to control their spacing and positioning, permanent deformation of the felt on the hammer and other characteristics which are uniquely associated with the striking of the hammer in a piano. Another technique that has been discussed is the use of photocells to detect hammer passage. Inductive methods are not viewed with optimism because they require the addition of a coil or core metal to the hammer which would destroy the dynamics of the hammer system. This would make the hammer mechanism unwieldy or even worse, seriously alter its musical quality. The use of variable resistors is also viewed with some degree of apprehension because of the difficulty of linking hammer movement to a variable resistor and the resultant drag which would necessarily accompany its operation.

It has been discovered that it is possible to paint a thin layer of conductive material on portions of the hammer which do not actually strike the string. Hammers used in pianos and harpsicords are shaped in accordance with an industry standard. Hammers ordinarily include a striking portion and additionally have exposed surface which does not strike the string. This structure utilizes the remaining portions of the hammer head to construct a plate of conductive material thereon, albeit rather thin, so that it can be coupled by capacitive linkage to pads of conducting materials carried on a printed circuit board arranged approximately at right angles to the string. The capacitive pads are placed close to the path of the hammer. They are spaced sufficiently apart from the hammer path to avoid interfering with movement of the hammer as it strikes the string. This discovery, however, has had to deal with problems in working with capacitive coupling. The basic problem is that the size of the pads yields a very small capcitance typically in the range of about 0.5 to about 5.0 picarfarads. This, of course, presumes the use of relatively small pads which are painted, sprayed or otherwise placed on the hammer and having a width less than the thickness of the hammer head, an air dielectric, and pads constructed by suitable photoetching techniques on printed circuit boards.

The customary method of playing a stringed percussive instrument conveys the expression desired by the musician to the instrument itself dependent on two factors. The loudness of the note is determined by the force of striking the keys of the keyboard. Thus, a louder note requires crisper playing by the pianist. The duration of the note depends on how long the key is depressed.

In the playing of a piano which is the most typical keyboard instrument and also the most popular, it is customarily played with two hands. It is customary for the musician to divide the keyboard in halves so that the left hand plays the base notes and the right hand plays the treble notes. Other combinations of keyboard segregations can be used including octave or even singlenote groupings. On the other hand, the present invention encodes rapidly played notes with differing intensities. Thus, the musician may first strike a loud note (fortissimo) and thereafter strike a pianissimo note. The variety is unlimited; the apparatus can recognize levels of expression which, dependent on cost and complexity, range as high as 16, 32 or even 64 levels of expression.

The apparatus is particularly useful in forming a signal which is to be recorded with the musical notes actually played as taught in applicant's copending disclosure application Ser. No. 485,983 which was filed on July 5, 1974. In that disclosure, applicant has set forth a system for recording the notes actually played. This is therefor intended as an improvement or an addition to that structure; that apparatus discloses an apparatus and method whereby the notes actually played by the musician are recorded. This apparatus is preferably used with the tape recording system which is disclosed, and adds the expression so that, on playback, the melody is correctly played with the right expression (loudness and duration).

The referenced disclosure sets forth suitable recording apparatus. It also shows a playback system where the signals which are recorded by the present invention are converted into variable sized driving signals for solenoids to modulate their striking force and duration, thereby providing full expression on reproduction of the recorded music.

SUMMARY OF THE DISCLOSURE

This disclosure is an expression encoding apparatus for a percussive keyboard instrument such as a piano or harpsicord. It responds to the striking of a hammer against a string. Two important factors are found in expression and they are the velocity of hammer movement which is related to the loudness of the note, and the other factor is the duration of the note as represented by the length of time that the key is depressed. This device detects hammer velocity.

The present dislcosure utilizes a conductive film placed on a nonstriking portion of the hammer, the film being connected to a suitable high voltage high frequency source. A printed circuit board is preferably erected perpendicular to a set of strings in the instrument. It supports first and second conductive pads. These pads are located along the locus of the hammer during movement. As the hammer travels past, suitable signals are coupled through the pads into connective circuitry. The two signals which are picked up are related to the velocity of the hammer movement, the elapsed time between passage of the hammer past each being related to velocity. Suitable latch circuits convert these signals into digital signals which are thereafter connected through a switch and converted into a voltage level which is applied to a sample and hold amplifier. The output of that is supplied to a convertor which forms a digital output of a suitable number of gradations, typically 16, 32 or 64 levels. The key is detected on opening and closure by incorporating a conductive film thereon which is in contact with a pair of terminals. One terminal is connected with a suitable high voltage high frequency source and the second terminal is connected to a reset gate which turn off the latches described above. Thus, the reset gate senses key closure which occurs on release of the key by the musician.

DESCRIPTION OF THE PREFERRED EMBODIMENT

Figure 1:
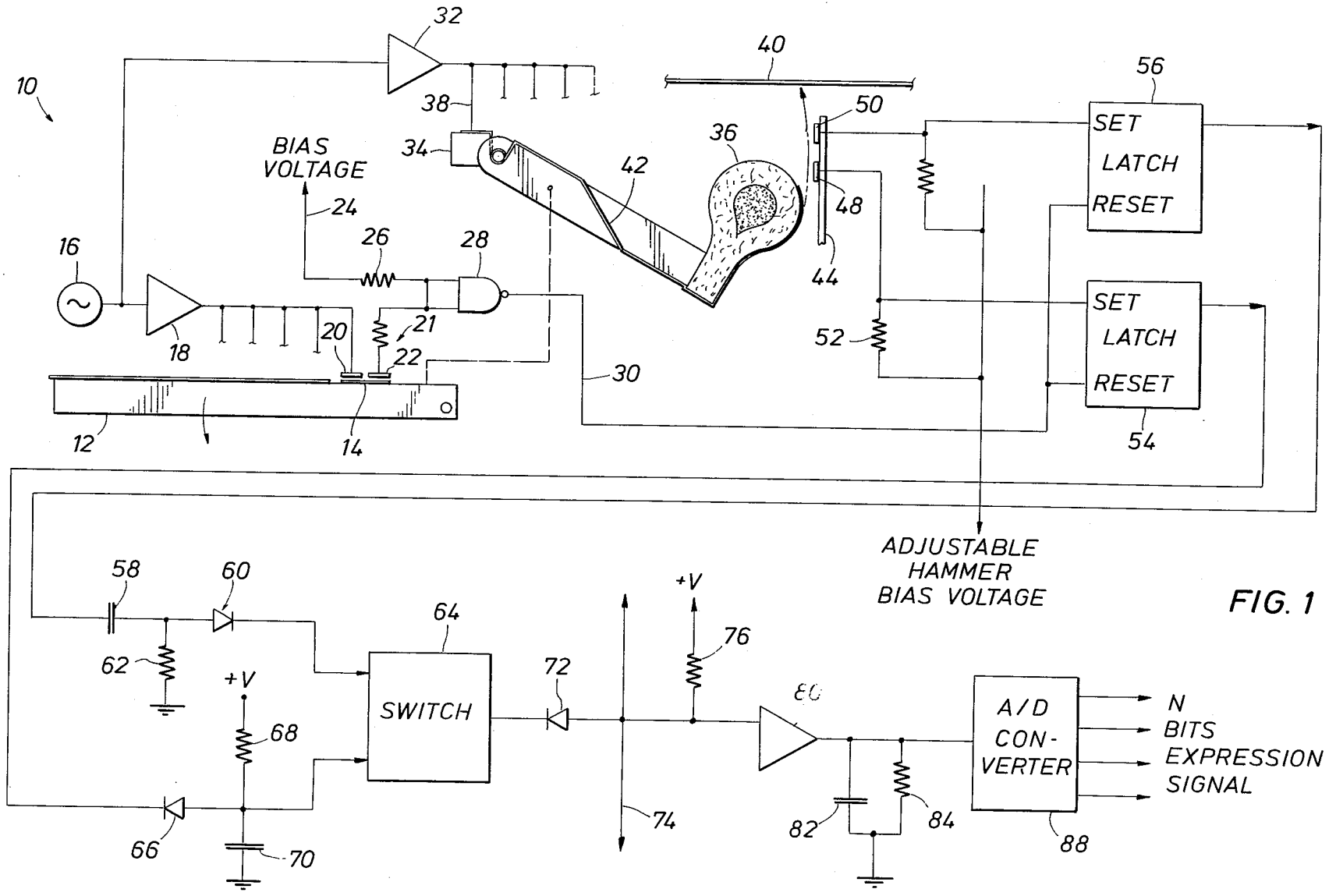
FIG. 1 is a combined mechanical and electrical schematic showing the expression encoding apparatus of the present disclosure.

In the single drawings, the numeral 10 identifies the expression encoding apparatus for the present invention. It cooperates with a typical percussive keyboard instrument such as a piano or harpsicord. The apparatus to be described is associated normally with a single key except where otherwise stated. The key which serves as an example is of course one of many keys in an entire keyboard. For instance, a conventional piano is equipped with eighty eight keys. Where the encoding apparatus 10 interconnects with similar euqiment, this will be noted.

The numeral 12 identifies a conventional key found in the keyboard of a musical instrument. It is mounted for depression by the musician. A return spring forces it upwardly to the quiescent position. The key 12 is struck or played by the musician and when it is depressed, it rotates about a pivot point which is not visible to the musician. The key 12 is modified by placing thereon a thin conductive coating of material indicated by the numeral 14. One suitable source of coating is a selectively conductive paint which is available under the trademark Aquadaq. This forms a conductive film on drying which is only a few mils thick.

The numeral 16 identifies an oscillator which is common to all keys of the keyboard. It is connected through an amplifier 18. The amplifier 18 provides a suitable high voltage high frequency signal to a termianl or contact 20. The terminal 20 is connected to each and every key from which a signal is to be encoded. A typical frequency is in the range of about 20 kilohertz, and typical voltage is about 20 to about 200 volts or more. The terminal 20 is contacted by the pad 14 when the key is at rest or unplayed. The pad 14 operates in a passive mode.

A similar terminal 22 spaced from the terminal 20 is capacitively coupled by the pad 14. When the key is in the unplayed condition, the pad 14 bridges the terminals 20 and 22 capacitively to connect them electrically. When the key is depressed, the capacitance decreases and the circuit is effectively broken.

The numeral 24 identifies a bias voltage conductor which is typically common to every key. It is connected through a series resistor 26 to a NOR gate 28. The resistor 21 protects the gate 28. The NOR gate 28 is thus provided with a high signal when the key is played and a low signal when it is unplayed. The NOR gate 28 forms a reset signal when the key is released by the player. The reset signal is delivered on the conductor 30 to other circuitry to be described.

The oscillator 16 is connected to a second amplifier 32. A single amplifier 32 will suffice for an entire musical instrument. It is connected to an individual hammer 36 supported on an individual pivot point 34. The pivot or mount 34 supports the key for upward striking against the lower side of the string 40. A conductor 38 extends from the amplifier 32 to the individual hammer 36. The amplifier 32 is connected to all the keys so that an individual conductor is provided for each, and each key is thus electrified as will be described.

The numeral 42 identifies a thin film applied to the hammer 36. This extends from the conductor 38 to the shaped head of the hammer. It is important to note that the material 42 is exaggerated in thickness. In actuality, it is only a few thousands of an inch thick. However, it is applied to the indicated regions of the hammer so that it communicates the high voltage high frequency signal from the conductor 38 to the arcuate head of the hammer. The coating on the hammer may be patterned in any suitable fashion. It is however, helpful to avoid coating on the very tip of the hammer which actually strikes the string. One reason for this is to avoid applying the high voltage signal to the string 40. Another reason is to avoid altering the musical characteristics of the hammer. The hammer normally is constructed of wood in the arm and head and is coated with various varnishes and other finishes to control its hardness. The head is coated or covered with a felt material. In any case, the musical qualities are preferably left unaltered so as to avoid changing the musical qualitites of the basic instrument.

The numeral 44 identifies a printed circuit board which is mounted approximately perpendicular to the string 40. It is positioned close to the path of movement of the hammer head. It supports a first conductive pad 48 and a second pad 50. The pads 48 and 50 are formed of conductive material on the board and serve as first and second capacitive pickoffs for detecting movement of the hammer. The hammer passes the first pad and then passes the second. The two pickoff pads are preferably made to a compromise size. They can be made larger to increase their capacitance. However, as they become larger they make the printed circuit board 44 a bit unwieldy and they also tend to cross connect to one another. For these reasons, they preferably have a capacitance with respect to the coating on the hammer in the range of about 0.5 to 5.0 picafarads with the hammer at its closest position to each. The hammer is adjusted so that it comes about ⅛ inch from each. If an AC signal of about 300 volts is applied to the hammer, it is possible to pickoff between 5 and 15 volts at the capacity pads with the hammer sweeping past the two pads. It will be further observed that the pad 50 is quite close to the string 40 and accordingly, the relative velocity of the hammer at the end of its stroke encoded. More will be noted concerning this later.

The first pad or sensor 48 is connected to an adjustable hammer bias voltage through a resistor 52, and it is applied to the set terminal of a latch 54. The latch 54 is preferably formed of CMOS integrated circuitry, one model being 4043. There is a reset terminal which is connected to the conductor 30. Thus, when the hammer passes, the latch is set and forms an output signal accordingly. When the key 12 is returned to the unplayed position the latch is then reset. The same circuitry is provided for the second pad or sensor 50. It thus operates the latch circuit 56. The latch 56 operates differently only as a result of the timed passage of the hammer head, and is otherwise structurally similar.

The latch 56 forms an output signal which is applied to a differentiating capacitor 58. The capacitor 58 is in series with a diode 60 to select only the positive-going signal from the latch 56. The differentiated signal is formed across a grounded resistor 62. This forms a spike which serves as a control signal for a switch 64.

The latch circuit 54 is connected through a suitable blocking diode 66 to a fairly high positive voltage source by a resistor 68. The resistor 68 is connected to ground through a capacitor 70. In the quiescent condition, the junction between the resistor and the capacitor is held steady at a low value by operation of the diode 66 which itself is connected to the output of the latch 54, a lower voltage. When the latch 54 forms a high output or a latched signal, the diode 66 pemits the capacitor then to charge up, and thereby forms a ramp signal for the switch 64. The switch 64 is preferably a CMOS integrated circuit, one suitable model being a 4016 switch. The signal from the second detector serves as a control signal turning the switch 64 on. The signal from the first detector is the variable which is to be switched on and off by the switch 64. When the control signal exceeds a threshold value the switch 64 is operated. The switch then passes whatever signal is applied to its input. The output of the switch 64 is a segment of a ramp voltage, the magnitude thereof being determined by the time of occurrence of the detection of the pad 50, an event related to the velocity of the hammer 36. For a soft note, a large voltage is passed by the switch 64. For a fortissimo note, a small voltage is passed by the switch. These will be inverted later on as will be explained.

All of the equipment described to this juncture (except for two or three exceptions) is duplicated for each key. Thus, there is a complete set of equipment for each key including the set switch 64 for each key. The switch 64 forms an output signal through a diode 72. At this point, the diode 72 is connected in parallel with other diodes of other keys. Indeed, the entire keyboard can be bridged together if desired. If not, the keyboard can be split, for instance between upper and lower keyboards. In any case, several diodes connect together in parallel. The keys of the keyboard are grouped in arbitrary fashion, into two equal groups, by octaves, and in any other fashion deemed appropriate. Several expression signals occur simultaneously and are common to form common expression in a given keyboard grouping. The numeral 74 represents the interconnection for duplicate or multiple keys in a grouping.

The terminal 74 is connected with a suitable B+ voltage by a resistor 76. This establishes a quiescent value input to an amplifier 80. The amplifier 80 is a sample and hold amplifier when considered in conjunction with the output grounded capacitor 82. The capacitor is discharged to ground by a resistor 84. The amplifier 80 of course inverts the output signal. It is only desirable that the gain be constant and that the output levels be calibrated in accordance with an assigned code of expression. The output signal is applied to an analog to digital convertor 88 which forms an output of N bits. Preferably, four, five or six bits of data will suffice. It is not necessary to break the signal range down into smaller increments; on the other hand, eight levels of expression is probably unduly limited. The output signal is a digital word of N bits length representing expression. The device is preferably calibrated so that the 16, 32 or 64 increments fully encompass the range of expression.

Consider the operation of the device as a whole. When the key 12 is first struck, the hammer is instantly set into motion and passes the first and second pickoff pads 48 and 50. They form time delayed signals. The two signals are used to form a variable signal which is related to the speed of the hammer. This signal is in turn applied to an amplifier 80. Considering the keyboard as a whole where duplicate equipment is installed on multiple keys, the apparatus preferably encodes a common expression for each struck key in a grouping. This is consistent with good technique in the playing of the instrument.

The note beings when the key 12 is struck. It ends when the key 12 is released. This forms a reset signal on the conductor 30 which terminates operation of the latches 54 and 56. This removes the signal on them. This causes the latches to be reset. This readies the circuit for subsequent operation. The key depressed indication to be recorded elsewhere can be taken from either latch 54 or 56 since the time differential between their outputs is small compared to the overall time differential of key and hammer operation.

All of the equipment shown in FIG. 1 is duplicated for each and every key. The only devices which are found in common to the apparatus include the oscillator 16, amplifier 18, amplifier 32, and all of the output equipment connected to the conductor 74. Preferably, two or more sets of equipment are provided on a given piano with the keyboard divided between bass and treble portions. In this instance, two convertors 88 would be required rather than one. This of course is an optional feature.

It is preferable to utilize the PC board 44 as the mounting board for the latches 54 and 56. This shortens the wiring and thus reduces the capacitance between the wiring and surrounding structure. The output of the latches 54 and 56 can be sent a substantial distance immune from wiring capacitance.

It is desirable to limit the amount of weight added to the hammer and to this end, the coating material which is placed on it is relatively thin and narrow where possible. It is preferably narrow on the shank of the hammer, and has a width typically equal to the width of the hammer 36 only where the hammer passes the pads 48 and 50.

Figure 2:
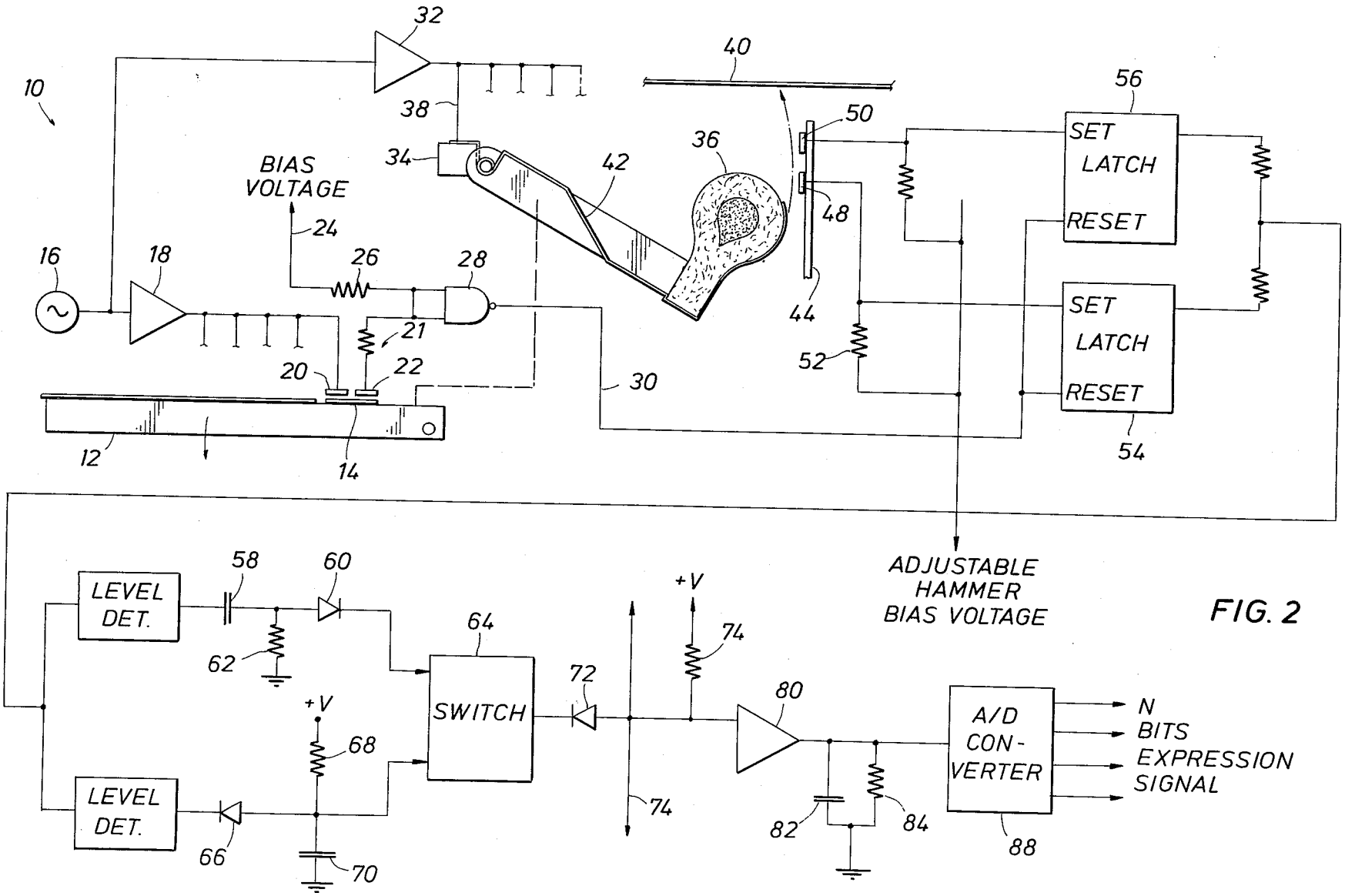
FIG. 2 is an alternate construction of the apparatus shown in FIG. 1.

FIG. 2 shows an alternate form of the circuit shown in FIG. 1. The same numerals are applied to similar components. The two signals from the latches 54 and 56 are added and then run through a single wire to a pair of level detectors. The two level detectors respond to form signals operating the switch in the same manner as described above. The construction of FIG. 2 is advantageous in that it reduces wiring from the PC board 44. The two latches and summing resistors are preferably mounted on the board and the output is carried by one wire for each key to another location.

Figure 3:
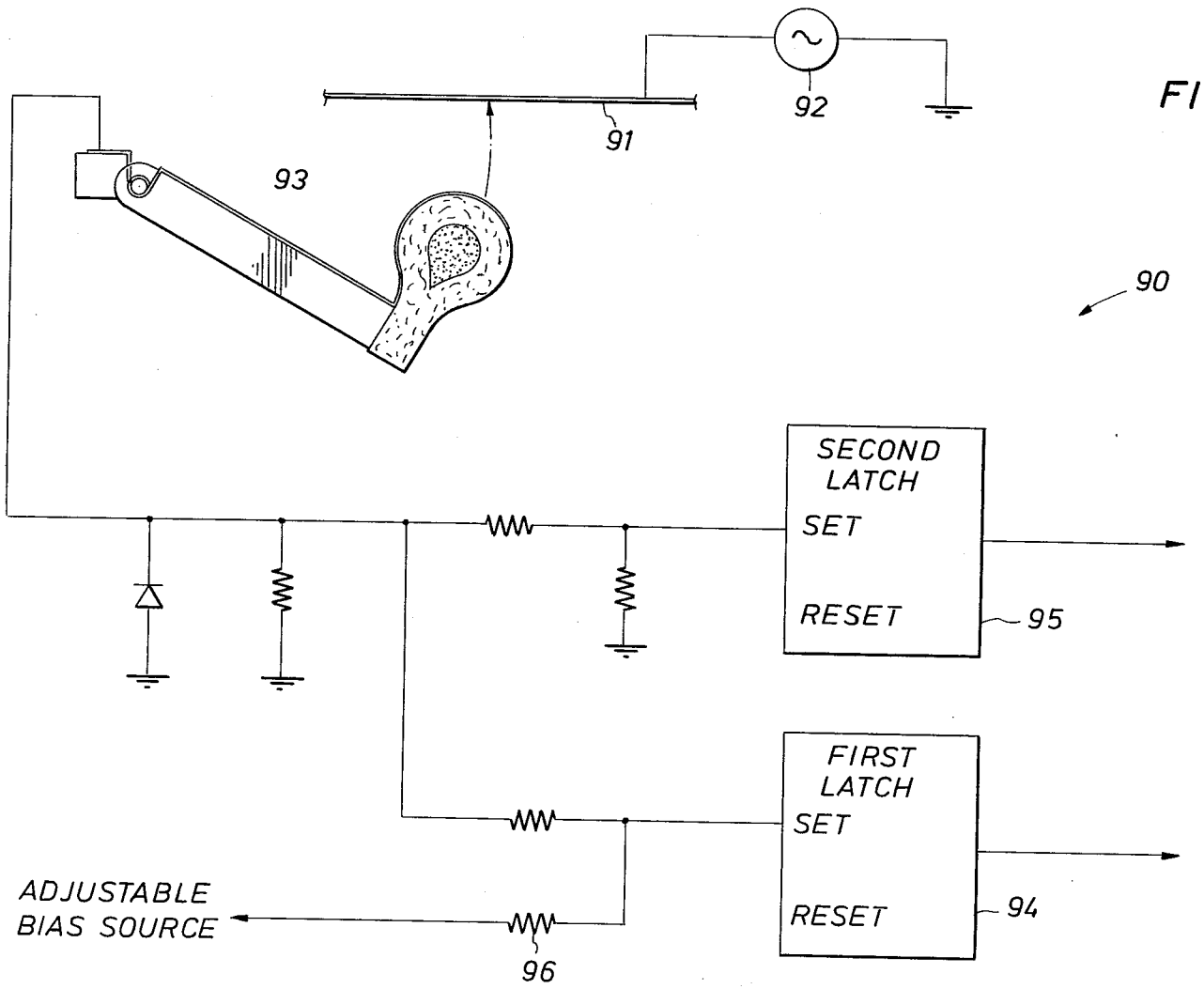
FIG. 3 is another alternate circuit for detection of hammer movement and its velocity.

FIG. 3 is an alternate form of circuit which costs less than the forms previously described. The embodiment 90 places a high frequency, high voltage signal on the piano string 91 from an oscillator 92. Representative values are 300 volts at 20 to 30 kilohertz. The hammer is coated at 93 with a few mils of the same coating material and it is applied to the hammer head at the point which strikes the string. The coating thus first, in mid flight, picks up a capacitively coupled high frequency signal which grows in amplitude until the hammer actually hits the string 91. When the contact occurs, a larger signal, reduced by resistive drops, is formed and serves as the second of the two timed signals.

The first signal is arbitrarily selected for the first latch 94 by adjusting a bias voltage at its input through a resistor 96. In other words, the first latch turns on when the ramp input achieves a level adjusted by the bias set through the resistor 96. By contrast, the second latch 95 turns on later because it is set to respond to the full voltage furnished via hammer contact with the string 91. Representative turn on values might be one volt for the first latch 94 and twelve volts for the second latch 95. A softer note struck on the piano moves the hammer slower which fact is reflected by a longer time interval between the two latches output signals. The output signals of the latches 94 and 95 are processed in the same manner as shown in FIG. 1; the latches 94 and 95 are connected to similar circuitry such as the components 58 to 72 of FIG. 1.

The arrangement of FIG. 3 is less expensive and still gives good response. There is some consternation at placing high voltage on the strings of the piano but it is possible to protect against shock by using a current limiting resistor in the oscillator 92.

The present apparatus can be used as a data input source for the music recording system of serial number 485, 983. The output of the latch 56 is a large amplitude signal adequate to drive that circuit. There is some time lag between the actual key movement and striking the string, the time lag being dependent on the hammer velocity. A pulse stretcher is helpful on reducing the variation in time lag. Therefor, the preferred interconnection from the latch 56 to the music encoding circuit is a pulse stretcher.

The foregoing is directed to the preferred embodiment of the present apparatus but the scope thereof is determined by the claims which follow.

I claim:

1. An apparatus for encoding the loudness of a note struck on a percussive keyboard instrument utilizing a hammer which strikes a sounding member, the apparatus comprising a proximity means for detecting velocity of the hammer toward the sounding member;

circuit means connected to said proximity means for forming an output signal of the velocity of the hammer as it passes said proximity means;

convertor means connected to said circuit means for forming a digital word which digital word encodes the velocity of the hammer as it moves past said proximity means, and wherein the loudness of the note struck by the hammer is related to the velocity of the hammer movement.

2. The apparatus of claim 1 including an oscillator connected to a conductive member affixed to the hammer which forms a signal detected by said proximity means.

3. The apparatus of claim 1 wherein said proximity means incorporates:

a conductive coating on the hammer;

a voltage source connected to the coating for impressing a signal thereon first and second capacitively coupled pads held near the path of movement of the hammer for detecting movement of the hammer by capacitive coupling from the voltage source applied to the hammer.

4. The apparatus of claim 3 including a latch circuit connected to each of said pads and forming an output binary signal when the capacitively coupled pads form analog signals input to said latches.

5. The apparatus of claim 4 including a reset signal source for said latches.

6. The apparatus of claim 5 including means for detecting the beginning and ending of playing of the key and forming a reset signal for both of said latches to thereby restore them to their beginning condition.

7. The apparatus of claim 6 wherein said latches connect to a means forming an analog voltage proportional to velocity.

8. The apparatus of claim 1 including an audio frequency oscillator forming an output signal connected to a piano string, and a connective member placed on the portion of the hammer which strikes th string, said connective member forming a signal for said circuit means.

9. The apparatus of claim 8 including an adjustable bias voltage source connected along with the signal from connective member to a latch circuit for selecting a threshold level for said latch.

10. The apparatus of claim 9 including a second latch set to trigger on contact of the hammer against the string which directly connects the connective member with said oscillator connected to the string.

* * * * *